US005553858A

United States Patent [19]

McKoon et al.

[11] Patent Number: 5,553,858

[45] Date of Patent: Sep. 10, 1996

[54] GOLF PUTTER

[76] Inventors: Carl T. McKoon, 1501 Knightsbridge Ct., Winston-Salem, N.C. 27127; Michael T. McKoon, 845 Apt. E Stadium Dr., Wake Forest, N.C. 27587

[21] Appl. No.: 440,070

[22] Filed: Jun. 28, 1995

[51] Int. Cl.[6] ..... A63B 69/36; A63B 53/16; A63B 53/02; A63B 53/12

[52] U.S. Cl. ..... 473/294; 473/306

[58] Field of Search ..... 273/77 R, 81.3, 273/81.2, 187.4, 80.7, 194 A, 194 R, 193 R, 81 D, 80.1

[56] References Cited

U.S. PATENT DOCUMENTS

| | | | |
|---|---|---|---|
| 3,260,525 | 7/1966 | Ortel | 273/80.7 X |
| 4,819,944 | 4/1989 | Doane | 273/81.3 X |
| 5,308,073 | 5/1994 | McKoon et al. | 273/187.4 X |

*Primary Examiner*—George J. Marlo

*Attorney, Agent, or Firm*—Petree Stockton LLP

[57] ABSTRACT

A golf putter includes a putter head having an elongated body with a striking side and a back side, a heel portion and a toe portion, and a substantially planar putting face for striking a golf ball, and the putter head is provided with an internally threaded opening proximate the heel portion. A fixed shaft and a removable shaft of substantially equal lengths extend substantially parallel to each other from positions on the putter head near the heel portion. Each shaft has a gripping section adapted to be gripped by one of the golfer's hands to move the golf putter. The fixed shaft is affixed to the putter head, and the removable shaft includes a threaded section removably engageable in the putter head internally threaded opening. An elongated connector joins the two gripping sections and is detachably fastenable to each of the gripping sections by a dowel at one end of the connector and a threaded fastener at the other end of the connector with the gripping section terminal ends in side-by-side relationship to each other.

6 Claims, 2 Drawing Sheets

GOLF PUTTER

BACKGROUND OF THE INVENTION

1. Field of the Invention

The present invention relates to a golf putter, and more particularly to a new and improved dual shafted golf putter for permitting greater control of the path of movement of the golf putter and allowing detachment of one of the dual shafts for use as a conventional single shafted golf putter.

2. Description of the Prior Art

Golf is an extremely demanding and perplexing sport which requires great accuracy and concentration, especially in the putting aspect of the sport. Such accuracy can be developed by improvement in the techniques for holding and stroking the golf clubs, including addressing and stroking the golf ball. In order to achieve the end result of moving the golf ball on a desired projectory with a high degree of accuracy and consistency, each of the foregoing steps is absolutely essential.

It is well known that a critical part of the game of golf is putting the golf ball with a putter, which occurs after the ball is positioned on the green. When putting a golf ball with a golf putter, a player normally grips the putter with the player's hands along the same area, since there is a single shaft having a handle. Normally, the player is required to grip the putter handle with one hand placed above the other in a somewhat unnatural placement of the hands. In such an unnatural placement of the player's hands on the handle, there is a tendency to turn the putter along its longitudinal axis by rolling or breaking the wrists. This tendency is detrimental for putting because a proper putting stroke involves using the shoulders and upper body, without the wrists affecting the stroke.

The use of a parallel pair of widely spaced handles has been suggested, for example in U.S. Pat. No. 1,919,221, to avoid the unnatural hand placement which occurs with the use of conventional golf clubs. As a result of the wide spacing, rotating the putter is not similar to that occurring when the player uses a single handle putter. The large handle-to-handle spacing of such putters has a feel which is different from a single handle putter, and does not offer any benefit to a golfer in the nature of training in the proper feel necessary to accomplish a polished putting stroke with a single handle putter. Nor do such putters offer any benefit to a golfer in the nature of training in the proper alignment between the handle and the face of the putter in a putting stroke.

The use of a pair of shafts has also been suggested, for example in U.S. Pat. No. 5,308,073, to allow the hands, arms and shoulders to follow the putting stroke path and thereby keep the face of the putter head perpendicular to the path of travel of the ball once it is stroked. Such dual shafted putters afford considerable advantages over dual handled putters for training purposes, but up to now, use of such dual handled or dual shafted putters has not been sanctioned by appropriate rule-making bodies for use in competition or tournament play.

Accordingly, there is a need for an improved golf putter with a shaft and handle system which can be used for training purposes to teach a player to position and move the player's hands, arms, and shoulders to follow the putting stroke path and thereby keep the face of the putter head perpendicular to the path of travel of the ball once it is stroked, which can be simply and easily converted to a conventional single shaft and handle golf putter for use in competition or tournament play, and which affords a player the benefit of competing or playing in tournaments using the same golf putter with which the player has trained and learned proper putting techniques and with which the player has become familiar. The present invention addresses that need.

SUMMARY OF THE INVENTION

The general purpose of the present invention, which will be described in greater detail, is to provide a new and improved dual shafted golf putter which can be used for training and teaching purposes and which can be quickly and easily converted for use in officially sanctioned competition or tournament play and which has all of the advantages of the prior art and none of the disadvantages/

To attain this purpose, representative embodiments of the present invention are illustrated in the drawings. The golf putter of the present invention makes use of a putter head having an elongated body with a striking side and a back side, a heel portion and a toe portion, and a substantially planar putting face for striking a golf ball. A fixed shaft and a removable shaft extend substantially parallel to each other from positions on the putter head near the heel portion. Each shaft has a gripping section adapted to be gripped by one of the golfer's hands to move the golf putter, The fixed shaft is securely affixed to the putter head, and the removable shaft is detachably fastenable to the putter head. For stability, an elongated connector joins the two gripping sections and is detachably fastenable to each of the gripping sections.

Preferably, the putter head has an opening formed near the heel portion which is provided with screw threads, and the removable shaft is provided with a corresponding threaded section. The threaded section of the removable shaft is threadably engageable in the threaded putter head opening, and the removable shaft is attached to the putter head by inserting the threaded portion in the opening and rotating the shaft, for example, clockwise about its longitudinal axis to screw the threaded portion into the threads of the opening. The removable shaft is likewise removable by rotating the shaft, for example, counterclockwise about its axis to unscrew the threaded portion from the threads of the opening.

Each of the shafts includes a straight portion and a bent portion, and the respective straight portions partially define and lie in a plane substantially perpendicular to the plane of the putting face. The fixed shaft extends from a position on the elongated body of the putter head near the heel portion and near the longitudinal axis of the elongated body about midway between the striking side and back side of the elongated body. The bent portion of the fixed shaft extends from the elongated body away from the heel portion and putting face. The putter head opening is likewise disposed on the elongated body of the putter head near the heel portion, and between the position on the putter head from which the fixed shaft extends and the putting face. The position from which the fixed shaft extends and the opening are arranged on a line which is substantially perpendicular to the longitudinal axis of the elongated body. When the removable shaft is attached to the putter head, the bent portion of the removable shaft extends from the elongated body away from the heel portion and back side of the elongated body. When the removable shaft is detached from the putter head, the putter head and fixed shaft are configured and arranged as a conventional single-shaft golf putter.

For stability, an elongated connector can be provided for joining the gripping sections of the respective shafts. For this purpose, each of the gripping sections has a terminal end, one of which is provided with a smooth bore or smooth sided opening, and the other of which is provided with a threaded bore or opening. The connector has opposing end portions, with a dowel member extending from one end portion of the connector and an opening formed in the other end portion of the connector. The connector is fastenable to the respective shafts by inserting the dowel member in the terminal end smooth sided bore of one of the shafts, and the other end of the connector is fastened to the other shaft with a threaded fastener such as a screw inserted through the opening in the other end of the connector and into the terminal end threaded bore of the other shaft. When so fastened, the elongated connector is disposed with its longitudinal axis substantially perpendicular to the longitudinal axis of the elongated body, and substantially perpendicular to the plane of the putting face of the putter head.

This outline focuses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and carried out in various ways.

It is to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved golf putter which enables control of movement of a player's hands, arms and shoulders to move the putter in a substantially straight line which is essential to mastering the skills of putting, which skills can be employed in competition and tournament play using a more difficult to control single shafted putter.

It is another object of the present invention to provide a novel golf putter having substantially parallel shafts which eliminates the strained position of the player's hands when using a single shafted putter and provides training in techniques assuring a proper stroke path necessary for good putting, which techniques can be transferred to a conventional single shafted putter using an overlapping grip.

Yet another object of the present invention is to provide a dual shafted golf putter which can be used for instruction and training purposes and which can be easily and quickly converted for use as a conventional single shafted putter for use in competition and tournament play.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 2:
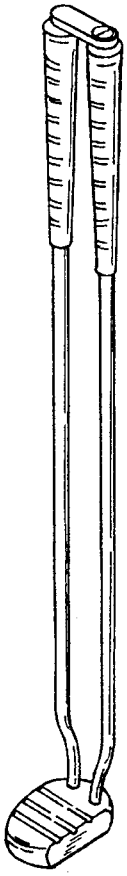
FIG. 2 is a perspective view of the golf putter shown in FIG. 1 with the removable shaft attached.
Figure 1:
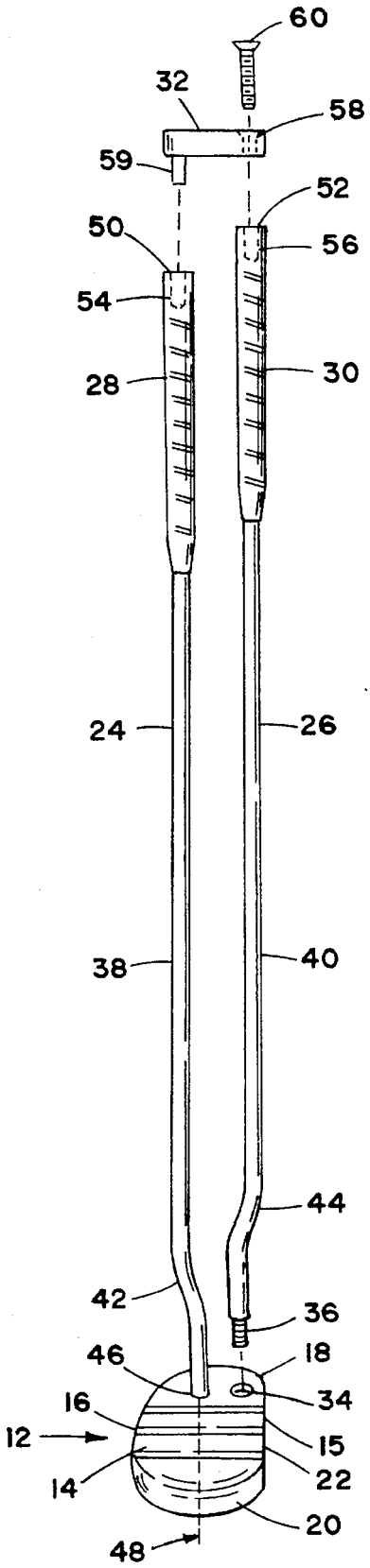
FIG. 1 is a front elevational exploded view of the golf putter of the present invention.

Referring now to the drawings, and specifically to FIG. 1, the golf putter of the present invention, shown generally as 10, includes a putter head 12 having an elongated body 14 with a striking side 15 and a back side 16, a heel portion 18 and a toe portion 20, and a substantially planar putting face 22 for striking a golf ball. Fixed shaft 24 and removable shaft 26 extend substantially parallel to each other from positions 46, 34 on putter head 12 near heel portion 18. Each shaft 24, 26 has a gripping section 28, 30 adapted to be gripped by one of a golfer's hands to move golf putter 10. Removable shaft 26 is detachably fastenable to putter head 12. For stability, an elongated connector 32 joins the two gripping sections 28, 30 and is detachably fastenable to each of gripping sections 28, 30.

Putter head 12 is provided with an opening 34 formed near heel portion 18 which has screw threads, and removable shaft 26 is provided with a corresponding threaded section 36. Threaded section 36 of removable shaft 26 is threadably engageable in threaded putter head opening 34. Removable shaft 26 is attached to putter head 12 by inserting threaded portion 36 in opening 34 and rotating removable shaft 26 clockwise about its longitudinal axis to screw threaded portion 36 into the threads of opening 34. Removable shaft 26 is likewise removable by rotating shaft 26 counterclockwise about its longitudinal axis to unscrew threaded portion 36 from the threads of opening 34.

Figure 3:
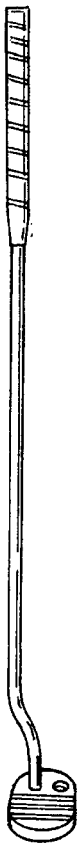
FIG. 3 is a front elevational view of the golf putter shown in FIG. 1 with the removable shaft detached.
Figure 4:
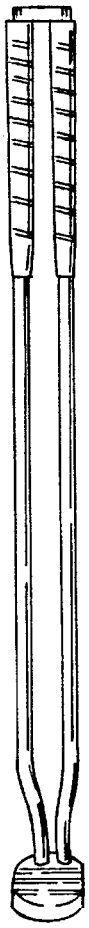
FIGS. 4 and 5 are front and rear elevational views of the golf putter as shown in FIG. 2.
Figure 5:
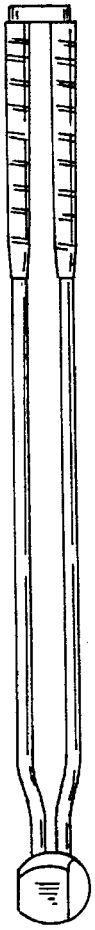
Figure 6:
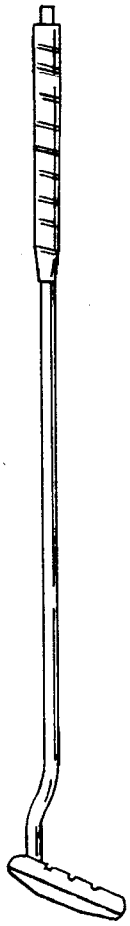
FIGS. 6 and 7 are opposing side elevational views of the golf putter as shown in FIG. 2.
Figure 7:
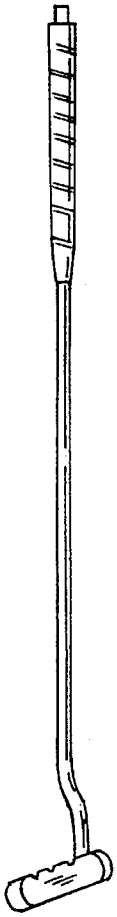

Each of shafts 24, 26 includes a straight portion 38, 40 and a bent portion 42, 44, and the respective straight portions 38, 40 partially define and lie in a plane substantially perpendicular to the plane of putting face 22. Fixed shaft 24 is affixed to and extends from a position 46 on elongated body 14 of putter head 12 near heel portion 18 and near the longitudinal axis, shown generally as 48, of elongated body 14 about midway between striking side 15 and back side 16 of elongated body 14. Bent portion 42 of fixed shaft 24 extends from elongated body 14 away from heel portion 18 and putting face 22 and toward toe portion 20 and back side 16. Putter head opening 34 is likewise disposed on elongated body 14 of putter head 12 near heel portion 18, and between position 46 on putter head 12 from which fixed shaft 24 extends and putting face 22, and position 46 and opening 34 are arranged on a line which is substantially perpendicular to longitudinal axis 48 of elongated body 14 and substantially perpendicular to the plane of putting face 22. When removable shaft 26 is attached to putter head 12, bent portion 44 of removable shaft 26 extends from elongated body 14 away from heel portion 18 and back side 16 of elongated body 14 and toward toe portion 20 and putting face 22. When removable shaft 26 is detached from putter head 12, putter head 12 and fixed shaft 24 are configured and arranged as a conventional single-shaft golf putter as shown in FIG. 3.

For stability, an elongated connector 32 is provided for joining gripping sections 28, 30 of respective shafts 24, 26. For this purpose, each of gripping sections 28, 30 has a terminal end 50, 52, one of which terminal ends 50 is provided with a smooth bore or smooth sided opening 54, and the other of which terminal ends 52 is provided with a threaded bore or opening 56. Connector 32 has opposing end portions, with a dowel member 59 extending from one end portion of connector 32 and an opening 58 formed in the other end portion of connector 32. Connector 32 is fastenable to the respective shafts 24, 26 by inserting dowel member 59 in the terminal end smooth-sided bore 54 of one of the shafts 24. The other end of connector 32 is fastened to the other shaft 26 with a threaded fastener such as screw 60 inserted through opening 58 and into the terminal end threaded bore 56 of the other shaft 26. When so fastened, elongated connector 32 is disposed with its longitudinal axis substantially perpendicular to the longitudinal axis of elongated body 14 and substantially perpendicular to the plane of putting face 22.

While a number of materials may be use to form the golf putter and its components described herein, the golf putter comprising the present invention in commercial form is constructed with True Temper pencil shafts which deliver a sensitive feel; the connector may be fabricated of plastic, wood or metal or any similar rigid or semi-rigid material; and the putter head can be made of stainless steel with a finish, for example, that eliminates glare.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A golf putter comprising:

a putter head having an elongated body with a striking side and a back side, a heel portion and a toe portion, and a substantially planar putting face for striking a golf ball, the putter head having an internally threaded opening formed proximate the heel portion;

a fixed shaft and a removable shaft having substantially equal lengths and substantially parallel to each other and extending from positions on the putter head proximate the heel portion, each shaft having a gripping section adapted to be gripped by one of a golfer's hands to move the golf putter, and the removable shaft having a threaded section corresponding to the internally threaded putter head opening removably engageable in the putter head opening; and an elongate connector having a longitudinal axis and joining the gripping sections and detachably fastenable to the gripping sections, each of the gripping sections having a terminal end, one of the gripping section terminal ends having portions defining a smooth bore opening and the other of the gripping section terminal ends having portions defining an internally threaded opening, the connector having opposing end portions with a dowel member extending from one end portion and receivable in the smooth bore opening of said one of the gripping section terminal ends and having an opening formed through the other end portion of the connector, and a threaded fastener receivable through the opening in said other connector end portion and engageable in the internally threaded opening of said other of the gripping section terminal ends with the longitudinal axis of the elongate connector substantially perpendicular to said planar putting face and with the gripping section terminal ends in spaced apart side-by-side relationship to one another.

2. The golf putter as claimed in claim 1, each of said shafts having a straight portion and a bent portion, the straight portions of the fixed shaft and removable shaft partially defining and lying in a plane substantially perpendicular to the plane of said putting face.

3. The golf putter as claimed in claim 2, wherein said putter head opening is disposed between said position on the putter head from which said fixed shaft extends and said putting face.

4. The golf putter as claimed in claim 3, wherein said bent portion of said fixed shaft extends from said elongated body away from said heel portion and said putting face, and said bent portion of said removable shaft extends from said elongated body away from said heel portion and said back side.

5. The golf putter as claimed in claim 4, wherein said position on the putter head from which said fixed shaft extends is disposed proximate the longitudinal axis of said elongated body.

6. The golf putter as claimed in claim 5, wherein said putter head opening and said position on the putter head from which said fixed shaft extends are arranged in an alignment substantially perpendicular to said longitudinal axis of said elongated body.

* * * * *